US005127690A

United States Patent [19]

Kim et al.

[11] Patent Number: 5,127,690

[45] Date of Patent: Jul. 7, 1992

[54] DOOR SAFETY STRIKER PLATE ASSEMBLY

[76] Inventors: Kenneth Kim; Doo W. Sur, both of 513 S. Western Ave., Los Angeles, Calif. 90020

[21] Appl. No.: 743,217

[22] Filed: Aug. 9, 1991

[51] Int. Cl.[5] ..... E05B 17/00

[52] U.S. Cl. ..... 292/340; 292/346; 292/DIG. 60

[58] Field of Search ..... 292/340, 346, 341.18, 292/341.19, DIG. 60

[56] References Cited

U.S. PATENT DOCUMENTS

| | | | |
|---|---|---|---|
| 576,449 | 2/1897 | Guenther | 292/346 |
| 2,255,860 | 9/1941 | Riedel | 292/346 X |
| 2,439,036 | 4/1948 | Bohnsack | 292/341.18 |
| 2,692,158 | 10/1954 | Tirschel | 292/346 |
| 3,279,840 | 10/1966 | Barone | 292/346 |
| 3,764,173 | 10/1973 | Griffith | 292/346 |
| 3,815,945 | 6/1974 | Lamphere | 292/340 |
| 3,825,291 | 7/1974 | Sprunger | 292/346 |

*Primary Examiner*—Richard E. Moore
*Attorney, Agent, or Firm*—Roger A. Marrs

[57] ABSTRACT

A striker plate assembly having a striker plate attachable to a door jamb and provided with a curved impact segment projecting forwardly of the jamb and a central opening for insertably receiving a sliding bolt. The striker plate further includes a mounting flange normal to the plate with securement slots and a pair of apertures located at the joint of the flange and the plate. A pair of adjustment plates form fit to a jamb shoulder and include spikes for penetrating the jamb and jamb shoulder for securement of the assembly. Recessed fastener openings are provided in the plates for positive fastening of the plates to the door jamb. The adjustment plates include angular cross-over slots for fastening adjustment to the width of the jamb shoulder.

5 Claims, 1 Drawing Sheet

FIG. 1.
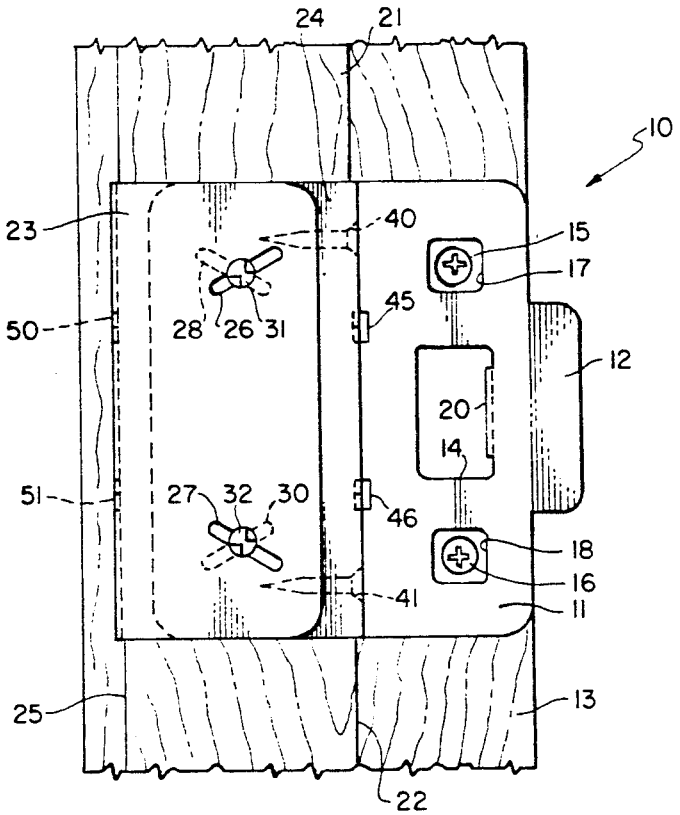
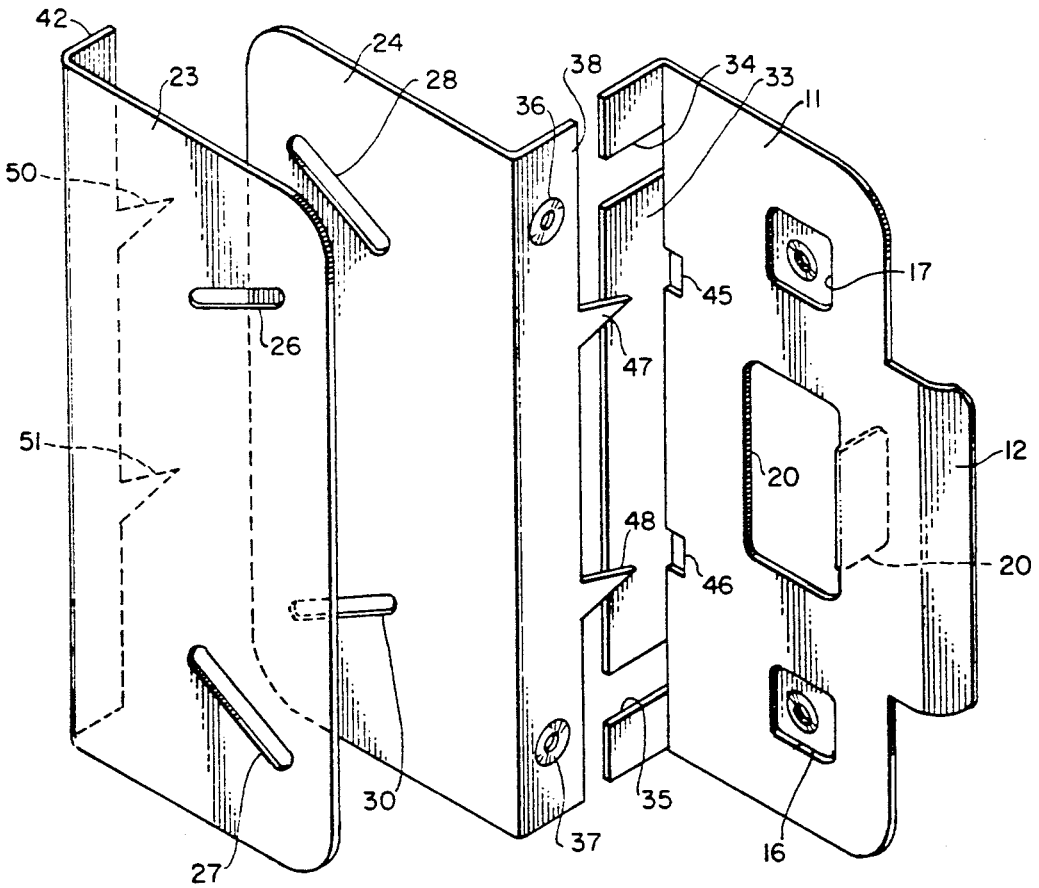
FIG. 2.

DOOR SAFETY STRIKER PLATE ASSEMBLY

BACKGROUND OF THE INVENTION

1. Field of the Invention

The present invention relates to the field of security devices and in particular to a novel safety door striker plate useful on conventional door jambs to prevent forced entry through a door which is bolted by means of kicking or otherwise breaking the door jamb at the bolt.

2. Brief Description of the Prior Art

It is the conventional practice to employ a variety of dead bolts on doors which extend between the swinging door and the door jamb. The dead bolt extends between the door and the jamb in such a manner as to provide a rigid securement or fastening so as to prevent passaged of unauthorized persons through the door or portal. Usually, the mechanism for the dead bolt is on the inside of the door, and when actuated, causes the sliding bolt to extend into a receptacle provided in the door jamb. Generally, the receptacle is in alignment with a central opening in a striker plate so the movable latch of the keylock mechanism will strike the plate and due to its spring bias, extend into the receptacle as well. Therefore, whether a movable latch of a lock mechanism or a sliding dead bolt is used, a striker plate is part of a conventional installation on the door jamb itself. Generally, fasteners such as screws retain the striker plate to a wooden door jamb and the striker plate adds strength to the area where the bolt secures to the jamb.

Problems and difficulties have been encountered when using such a conventional bolting system, which stem largely from the fact that wooden jambs may be readily kicked or broken so that the desired effect of a dead bolt or locking mechanism is avoided. An intruder may readily forcibly impact the door where the bolt or latch is located and the bolt or latch itself will be driven through the relatively weakened wood of the door jamb at that precise location. Obviously, repair is extensive and costly, as well as time-consuming. Furthermore, the express purpose and reason for locking the door is avoided since access can be made by destroying the door jamb through kicking or otherwise hammering at the bolt location.

Therefore, a long-standing need has existed to provide a novel safety latch for striker plate which will strengthen the door jamb and at the same time permit removable disposition of a dead bolt or the like into the conventional receptacle. Such a device must be easy to install and convenient to use as well as adaptable to a variety of different width door jambs and door jamb designs.

SUMMARY OF THE INVENTION

Accordingly, the above problems and difficulties are obviated by the present invention which provides a novel striker plate assembly comprising a striker plate having a flange adapted to bear against the shoulder portion of the door jamb and which further includes a pair of adjusting plates having downwardly depending flanges wherein a selected flange lies adjacent to the striker plate flange so that fasteners common to both flanges may be employed to retain the plates in place. Additional fasteners are employed for holding the striker plate to the door jamb and angular slots provided in the pair of adjustable plates are arranged to cross over one another so as to accommodate the width of the door jamb shoulder whereby additional fasteners may be employed to secure the adjusting plate to the jamb shoulder. A feature resides in the fact that apertures are provided in the striker plate for receiving prongs carried on the ends of the selected flange adjacent to the flange of the striker plate and additional prongs are provided on the other flange of the adjustment plates so that the two pairs of prongs embed within the door jamb shoulder Therefore, it is among the primary objects of the present invention to provide a novel door safety striker plate which will accommodate installing on a variety of sizes and widths of door jambs and which when installed will prevent the kicking or forcible entry into a room by breaking the door jamb at the latch plate.

Another object of the present invention is to provide a novel door safety latch assembly incorporating a striker plate having means for adjustably mounting the plate to a variety of contoured and different sized door jambs.

Another object of the present invention is to provide a novel door safety striker plate having adjustable means for accommodating a variety of door jamb shoulder widths, as well as providing spaced-apart prongs intended to embed within the door jamb for holding the assembly in place in cooperation with screw fasteners.

Yet another object of the present invention is to provide a novel door safety latch plate which includes adjustable means extending the latch plate across the jamb shoulder so as to provide a band of metal at the bolt location of the locking mechanism so as to reinforce and bolster the door jamb at the bolt location.

Yet another object of the present invention is to provide a novel door safety striker plate that is easy to install and may be readily installed without the use of special knowledge, techniques or special equipment so that the door jamb is protected and reinforced.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front elevational view showing the door safety striker plate assembly in its installed position on a door jamb and door jamb shoulder in accordance with the present invention; and FIG. 2 is an exploded front elevational view of the novel door safety striker plate assembly of the present invention illustrating the alignment of components preparatory for installation.

DESCRIPTION OF THE PREFERRED EMBODIMENT

Referring to FIG. 1, the novel door safety striker plate assembly is illustrated in the general direction of arrow 10 which includes a striker plate 11 having an outwardly projecting curved segment 12 intended to be struck by a moving latch in the lock mechanism carried on a swinging door. As is the conventional practice, the striker plate includes a central opening 14 which is in alignment with a receptacle formed in a door jamb 13 so that the movable latch will enter the receptacle when it has traveled past the segment 12. The striker plate is attached to the door jamb 13 by means of fasteners 15 and 16, which may be screws or the like. Preferably, the fasteners are occupied within recesses 17 and 18 so that the heads of the screws will not interfere with the swinging of the door when it is opened and closed.

For alignment purposes, an alignment plate 20 is provided normal to the surface of the plate 11 so that the alignment plate for portion 20 fits inside the receptacle in the door jamb 13.

It is to be noted that the door jamb is composed of wood which would be normally susceptible for breakage in the event an intruder wishes to kick or otherwise impact the door adjacent the bolt area. Also, the conventional door jamb includes a jamb shoulder 21 having a front face 22 against which the edge of the swinging door closes when the door is in a closed position. The assembly of the present invention includes a pair of adjusting plates, indicated by numerals 23 and 24 respectively which are placed in an overlapping position so as to accommodate the width of the door jamb shoulder 21. The shoulder 21 also includes a rear face 25 and the distance between faces 22 and 25 is accommodated by the overlapping plates 23 and 24 by overlapping angular slots in the respective plates. For example, plate 23 includes slots 26 and 27 so that the slots diverge with respect to one another in angular relationship while numerals 28 and 30 represent diverging slots carried on plate 24. Fasteners, such as screws 31 and 32, pass through the overlapped slots for securement of the plates to the shoulder 21.

Referring now in detail to FIGS. 1 and 2, it can be seen that the striker plate 11 includes a back flange 33 having a pair of spaced-apart openings 34 and 35. These openings are in alignment with countersunk or recessed openings 36 and 37 carried on an edge flange 38 carried on one side of the plate 24. Fastening screws 40 and 41 pass through the aligned openings 34 and 36 and 35 and 37 for retaining the plates 11 and 24 onto the face 22 of the jamb shoulder 21. It is to be understood that the flange 33 fits under the flange 38 so as to be disposed between the flange 38 in the face 22.

Also, to complete reinforcement, the plate 23 includes a back flange 42 which bears against the shoulder face 25. When the flanges 38 and 42 are against the respective faces 22 and 25, the screws 30 and 31 may be placed through the crossed slots on their respective adjustment plates for completing the fastening or securement procedure.

It is also to be noted that the striker plate 11 includes a pair of spaced-apart apertures 45 and 46 through which prongs 47 and 48 project into an embedded condition with the wood of the jamb 13. Similar prongs 50 and 51 are provided in a downwardly depending disposition from the edge of flange 42 carried on plate 23. The latter prongs will dig into the door jamb to complete installation.

Therefore, it can be seen that the assembly of the present invention will readily accommodate a variety of wooden door jambs wherein the width of the shoulder 21 may vary. The jamb shoulder is completely reinforced by means of the metal overlapping adjustment plates by means of the respective flanges 42 and 38 bearing against the shoulder faces 22 and 25. Also, the flange 33 reinforces the assembly so that once installed, the load-bearing characteristics provide for dispersal of impact forces being distributed or introduced directly into the door jamb itself or the closed door. Impact forces against a bolt which interconnects the door with the jamb are distributed through the metal plates which provide the added and reinforcing strength for the door jamb, including the shoulder. Therefore, the weakening of the door jamb by the means of a receptacle to receive the bolt is compensated by the reinforcement of the metal plate. Stability is further provided by means of the pronged arrangement on the adjustment plate and the interconnection of prongs 47 and 48 with the striker plate 11 through the apertures 45 and 46. Once assembled, the door jamb is reinforced and adapted to carry impact loads for distribution to surrounding structural material While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a door jamb construction having a jamb shoulder and flat jamb surface, the improvement which comprises:

a striker plate secured to said flat jamb surface;

overlapping adjustable plates secured to said jamb shoulder;

means carried on said adjustable plates to provide for width adjustment to said jamb shoulder; and stabilizing means interconnecting said overlapping adjustable plates with said striker plate.

2. The invention as defined in claim 1 wherein:

said stabilizing means includes a pair of spaced-apart prongs on each adjustable plate; and said striker plate having apertures for insertably receiving one pair of said prongs.

3. The invention as defined in claim 2 wherein said adjustable plates include a downwardly depending flange on one side of said overlapped adjustment plates terminating with said respective pairs of prongs.

4. The invention as defined in claim 3 wherein: said striker plate includes an edge flange having mounting slots in alignment with mounting holes on a selected one of said adjustable plates.

5. A door safety striker plate assembly comprising the combination of:

a striker plate having a central opening disposed between two opposite sides;

a curved impact segment carried on one of said striker plate sides and a flange carried on the other striker plate side normal to said striker plate;

adjustment means carried on said striker plate flange having a pair of overlapping plates adapted to be set to a desired width across their overlapped dimension;

said adjustment plates having aligned angular slots accommodating passage of securement fasteners;

said adjustment plates having downwardly depending prongs stabilizing said adjustment plates with respect to said striker plate;

screw fasteners for securing said adjustment plates together to a door jamb; and screw fasteners for securing said striker plate to the door jamb.

* * * * *